US008471134B2

(12) United States Patent
Chang

(10) Patent No.: US 8,471,134 B2
(45) Date of Patent: Jun. 25, 2013

(54) BASS DRUM PEDAL ASSEMBLY OF DRUM KIT

(76) Inventor: Chi-Cheng Chang, Taichung (TW)

( * ) Notice: Subject to any disclaimer, the term of this patent is extended or adjusted under 35 U.S.C. 154(b) by 0 days.

(21) Appl. No.: 13/343,698

(22) Filed: Jan. 4, 2012

(65) Prior Publication Data

US 2013/0087035 A1 Apr. 11, 2013

(30) Foreign Application Priority Data

Oct. 7, 2011 (TW) ..... 100218834 U

(51) Int. Cl.
*G10D 13/02* (2006.01)

(52) U.S. Cl.
USPC ..... 84/422.1

(58) Field of Classification Search
USPC ..... 84/422.1
See application file for complete search history.

(56) References Cited

U.S. PATENT DOCUMENTS 5,990,401 A * 11/1999 Braun et al. ..... 84/422.1
6,568,894 B2 * 5/2003 Golden et al. ..... 411/351
2012/0087723 A1 * 4/2012 Shafer et al. ..... 403/361

* cited by examiner

*Primary Examiner* — Christopher Uhlir

(57) ABSTRACT

The bass drum pedal assembly includes a first connector, mounted on a shaft driven by a drum pedal; a second connector, engaging with the first connector, and coupled to a universal joint which links a connecting rod; and a positioning mechanism, comprising a central positioning member, an elastic member and a pin. The elastic member is put around the central positioning member to make the central positioning member elastically slidably disposed in a central hole of the first connector. The pin is inserted into a through hole at a lateral side of the first connector to press the central positioning member and the elastic member so that the central positioning member is elastically inserted in central holes of the first connector and the second connector.

10 Claims, 7 Drawing Sheets

BASS DRUM PEDAL ASSEMBLY OF DRUM KIT

BACKGROUND OF THE INVENTION

1. Technical Field

The invention relates to drum kits, particularly to pedals of bass drums.

2. Related Art

A conventional double-bass-pedal of a bass drum includes a first pedal and a second pedal. The first pedal will directly drive a first mallet to hit a bass drum when it is pressed down, and the second pedal will drive a link mechanism to indirectly move a second mallet. Such a link mechanism is disposed between the second pedal and mallet and includes a universal joint and a connecting rod. When a user steps on the second pedal, a shaft coupled to the second pedal will be moved to drive the universal joint and connecting rod, and finally the mallet hit the bass drum. A bass drum is very important in a band because it controls the tempo. Thus, the time delay between stepping on the pedal and moving the mallet should be as short as possible for really accurate tempos. However, the conventional pedal structure has several drawbacks as follows:

1. The shaft is fastened to the universal joint by directly screwing up, so damage to screws and scratches on the shaft tends to occur. Such situations will cause loosening or inaccurate transmission.

2. Vibration from the motions of stepping on the pedal is significant, so contortion, shift or looseness appears easily. Also, this will cause time delay between stepping and hitting and drummers' toilsomeness.

3. The conventional structure is hard to be assembled because it requires using hand tools and costs much time and care. Also, inaccurately assembling easily occurs.

SUMMARY OF THE INVENTION

An object of the invention is to provide a bass drum pedal assembly, which replaces screwing with engagement to prevent from screw damage and scratches.

Another object of the invention is to provide a bass drum pedal assembly, which can prevent contortion, shift and looseness caused by screwing.

Still another object of the invention is to provide a bass drum pedal assembly, which does not require using hand tools, can save time cost and can avoid inaccurate assembling.

To accomplish the above objects, the bass drum pedal assembly of the invention includes a first connector, mounted on a shaft driven by a drum pedal; a second connector, engaging with the first connector, and coupled to a universal joint which links a connecting rod; and a positioning mechanism, comprising a central positioning member, an elastic member and a pin. The elastic member is put around the central positioning member to make the central positioning member elastically slidably disposed in a central hole of the first connector. The pin is inserted into a through hole at a lateral side of the first connector to press the central positioning member and the elastic member so that the central positioning member is elastically inserted in central holes of the first connector and the second connector.

DETAILED DESCRIPTION OF THE INVENTION

Figure 1:
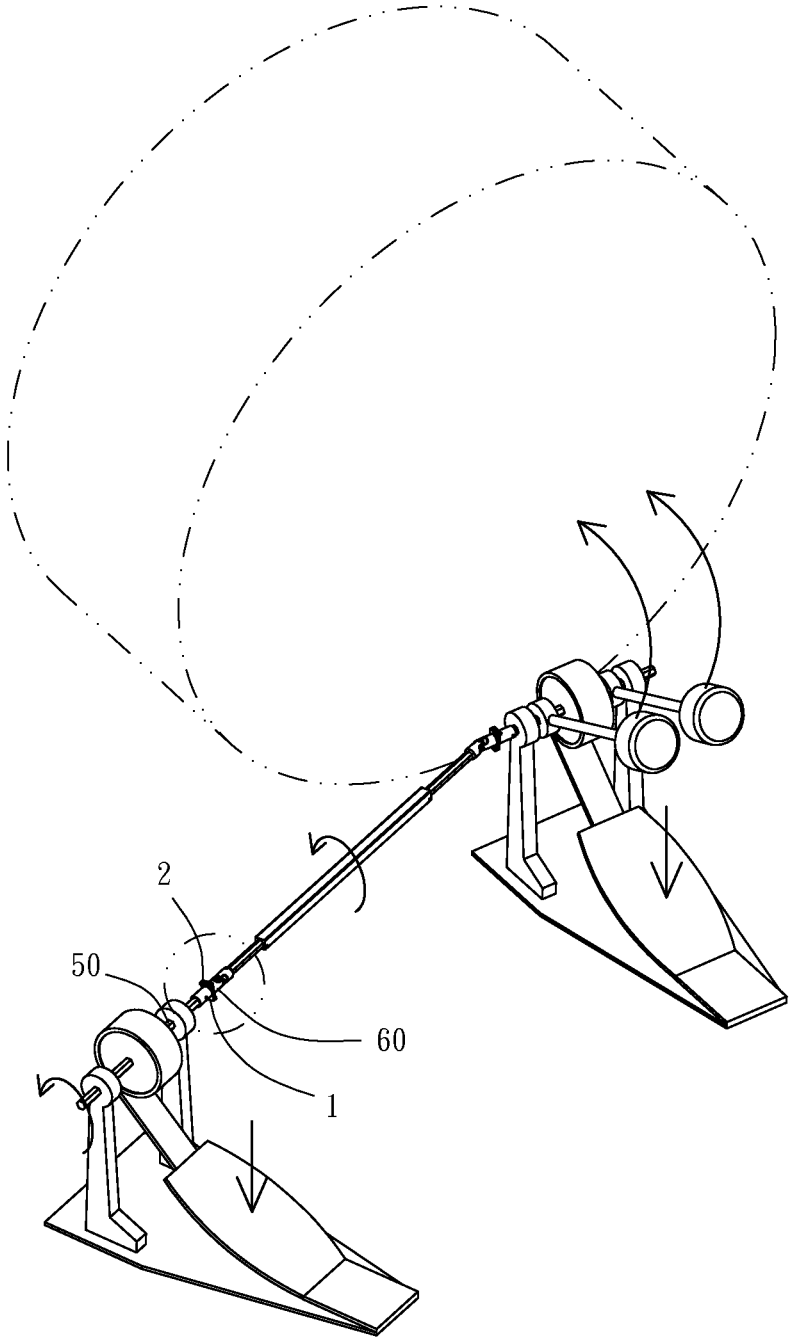
FIG. 1 is a schematic view of the invention with a bass drum.
Figure 2:
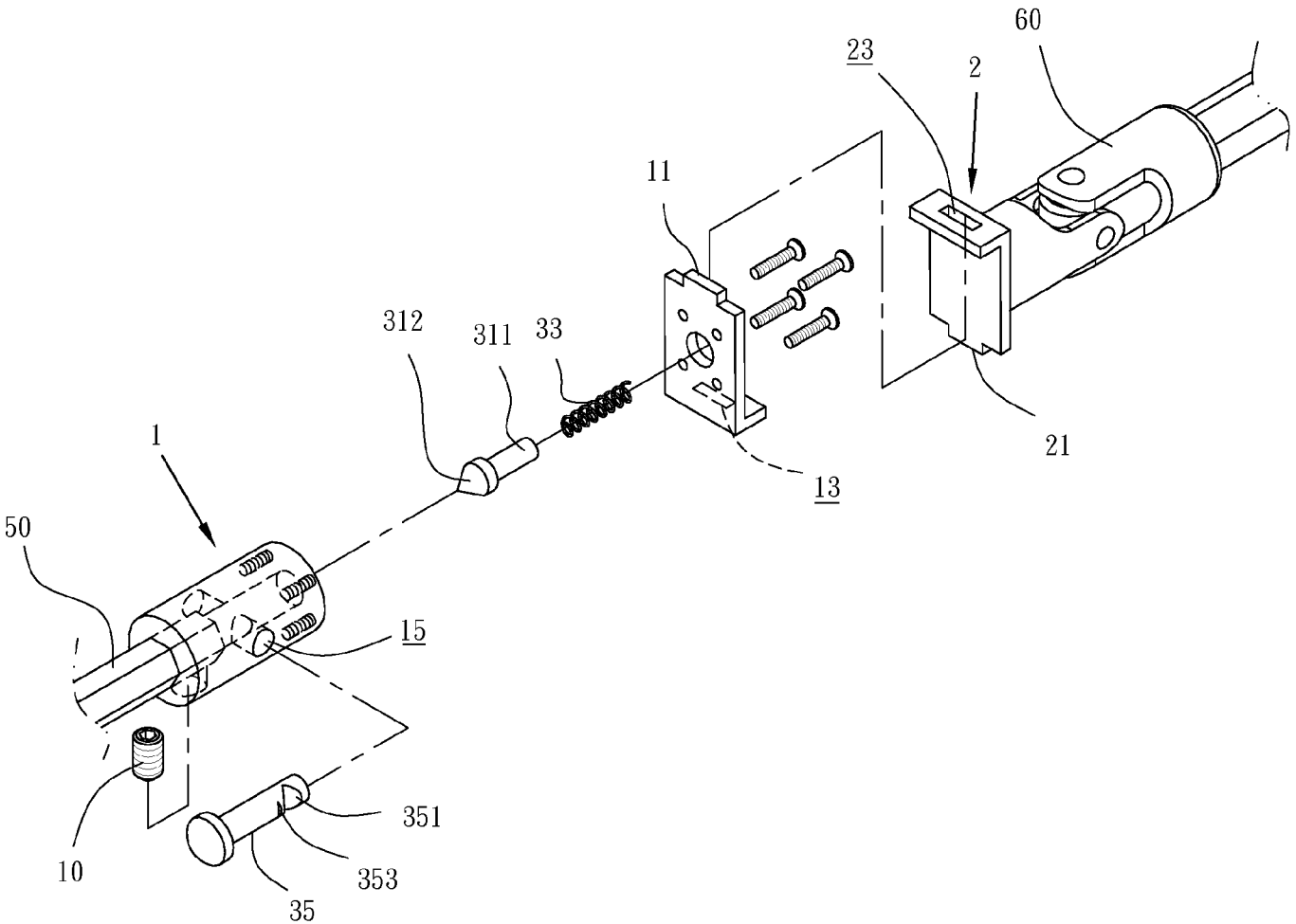
FIG. 2 is an exploded view of the first embodiment of the invention.
Figure 3:
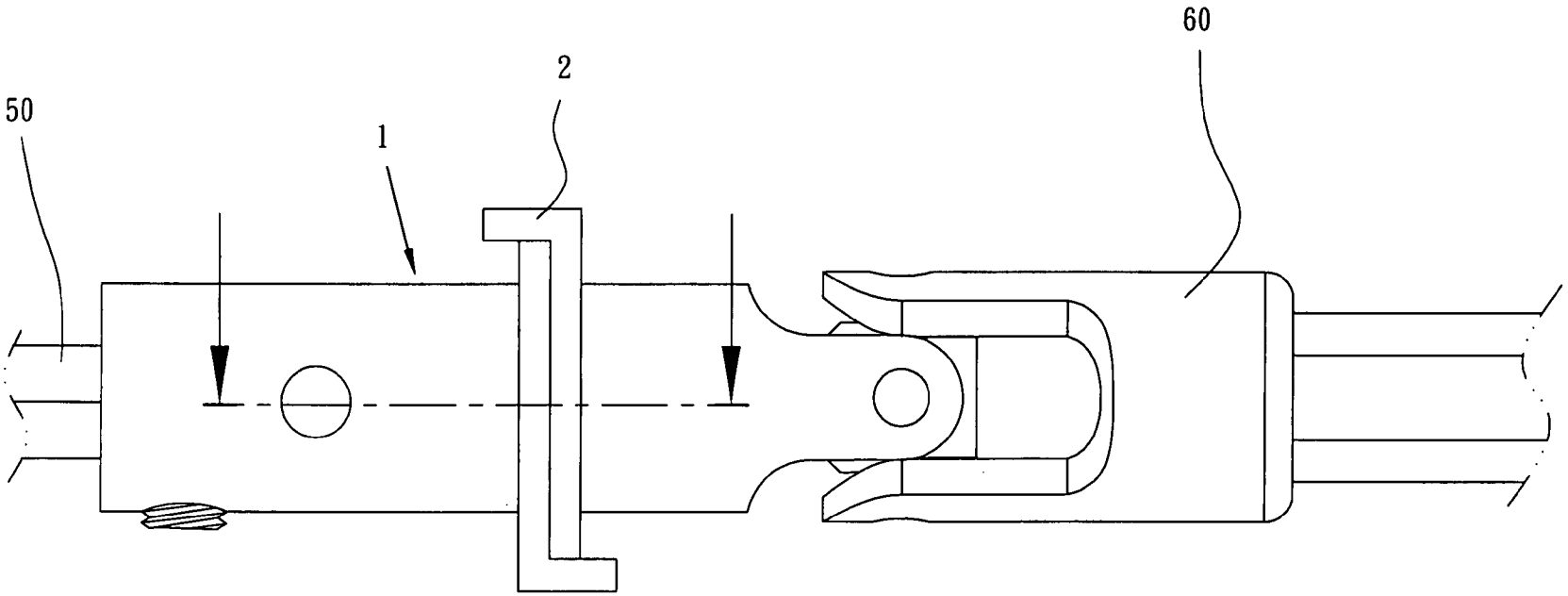
FIG. 3 is a segmentary side view of the first embodiment of the invention.

Please refer to FIGS. 1-7. The bass drum pedal assembly of the invention includes a first connector 1, a second connector 2 and a positioning mechanism 3.

The first connector 1 is mounted on a shaft 50 driven by a drum pedal and includes a stopper bolt 10 for ensuring the shaft 50 to be unrotatable against the first connector 1.

The second connector 2 engages with the first connector 1 and couples to a universal joint 60 which links a connecting rod of a bass drum. Each of the first connector 1 and the second connector 2 is formed into an L shape. A side of the first connector 1 is formed with a first engaging portion 11, and a side of the second connector 2 is formed with a second engaging portion 21. The first and second connectors 1, 2 can engage with each other by inserting the first engaging portion 11 into a second inserting portion 23 of the second connector 2 and inserting the second engaging portion 21 into a first inserting portion 13 of the first connector 1.

The positioning mechanism 3 includes a central positioning member, an elastic member 33 and pin 35. The central positioning member may be a central bar 311 or a central ball 313. The first embodiment shown in FIGS. 2-5 adopts the central bar 311 as the central positioning member and the second embodiment shown in FIGS. 6 and 7 adopts the central ball 313 as the central positioning member. The elastic member 33 may be a spring and is put around the central positioning member to make the central positioning member elastically slidably disposed in a central hole of the first connector 1. The pin 35 is inserted into a through hole 15 at a lateral side of the first connector 1 to press the central positioning member and the elastic member 33 so that the central positioning member is elastically inserted in central holes of the first connector 1 and the second connector 2. The pin 35 is formed with a backward positioning recess 351 for temporarily positioning the central positioning member when it is being pushed by the elastic member 33 to backwards shift and a forward positioning recess 353 for temporarily positioning the central positioning member when it is being pushed by the pin 35 to forwards shift. The backward positioning recess 351 is deeper than the forward positioning recess 353.

When assembling, the first engaging portion 11 of the first connector 1 and the second engaging portion 21 of the second connector 2 are directed to the second inserting portion 23 of the second connector 2 and the first inserting portion 13 of the first connector 1, respectively, to make the first and second connectors 1, 2 engage with each other.

Figure 4:
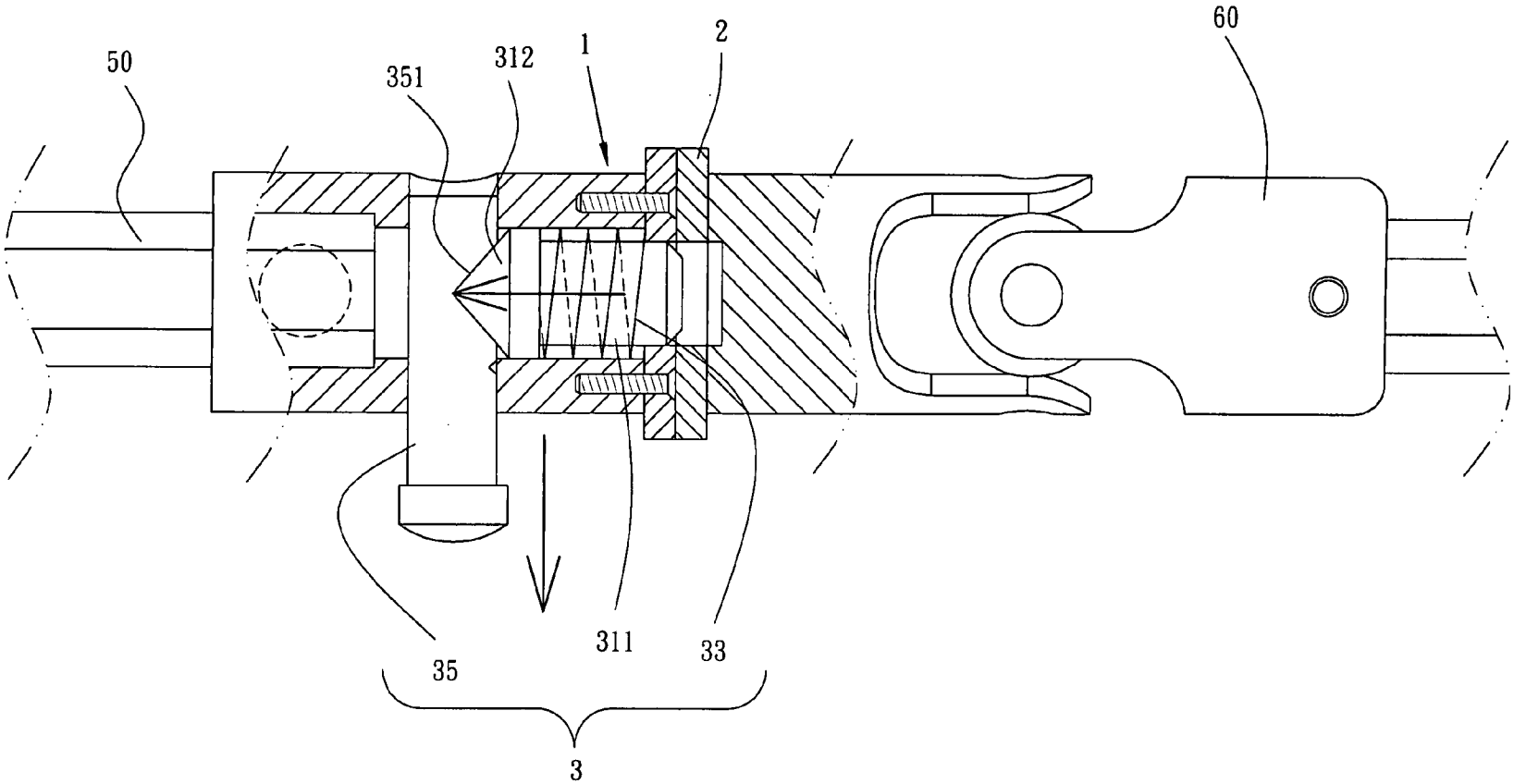
FIG. 4 is a schematic view showing the first status of the first embodiment of the invention.
Figure 5:
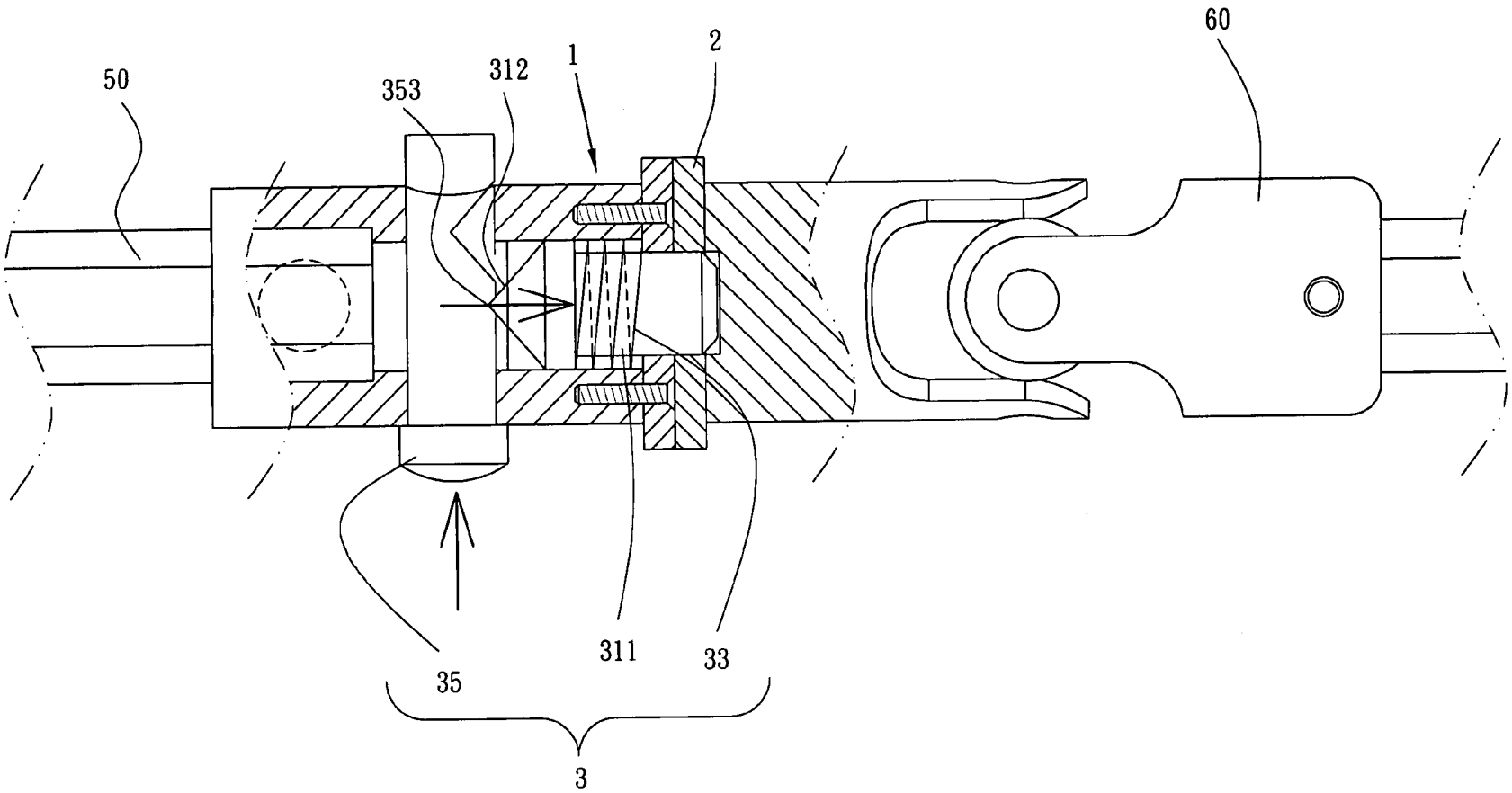
FIG. 5 is a schematic view showing the second status of the first embodiment of the invention.

For the first embodiment, please refer to FIGS. 4 and 5. When the connectors 1, 2 have engaged with each other and the pin 35 has not pressed the central positioning member yet, the end of the central bar 311, which is towards the second connector 2, is pushed by the elastic member 33 to move back into the first connector 1. Additionally, the other end of the central bar 311 is formed with a protrusion 312 which can be temporarily positioned in the backward positioning recess 351 as shown in FIG. 4. When a user pushes the pin 35 inwards, the central bar 311 is forced by the pin 35 to escape from the backward positioning recess 351 and to move into the forward positioning recess 353 as shown in FIG. 5. At this time, the central bar 311 presses the elastic member 33 and enters central holes of the first and second connectors 1, 2 to ensure accurate engagement between the first connector 1 and the second connector 2. When disassembling, the pin 35 should be slightly pulled out to release the central bar 311. At this time, the central bar 311 is pushed backwards to move into the first connector 1.

Figure 6:
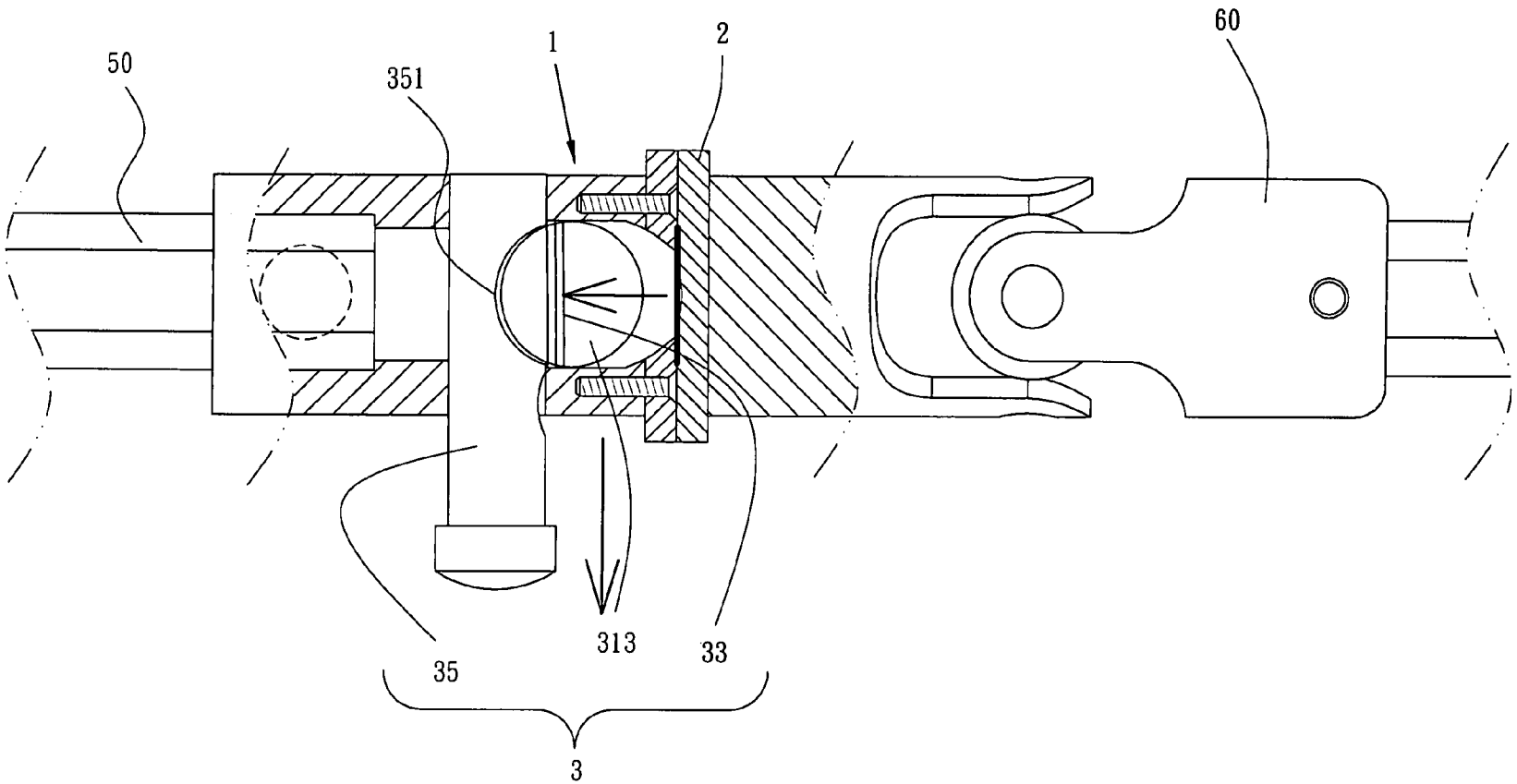
FIG. 6 is a schematic view showing the first status of the second embodiment of the invention.
Figure 7:
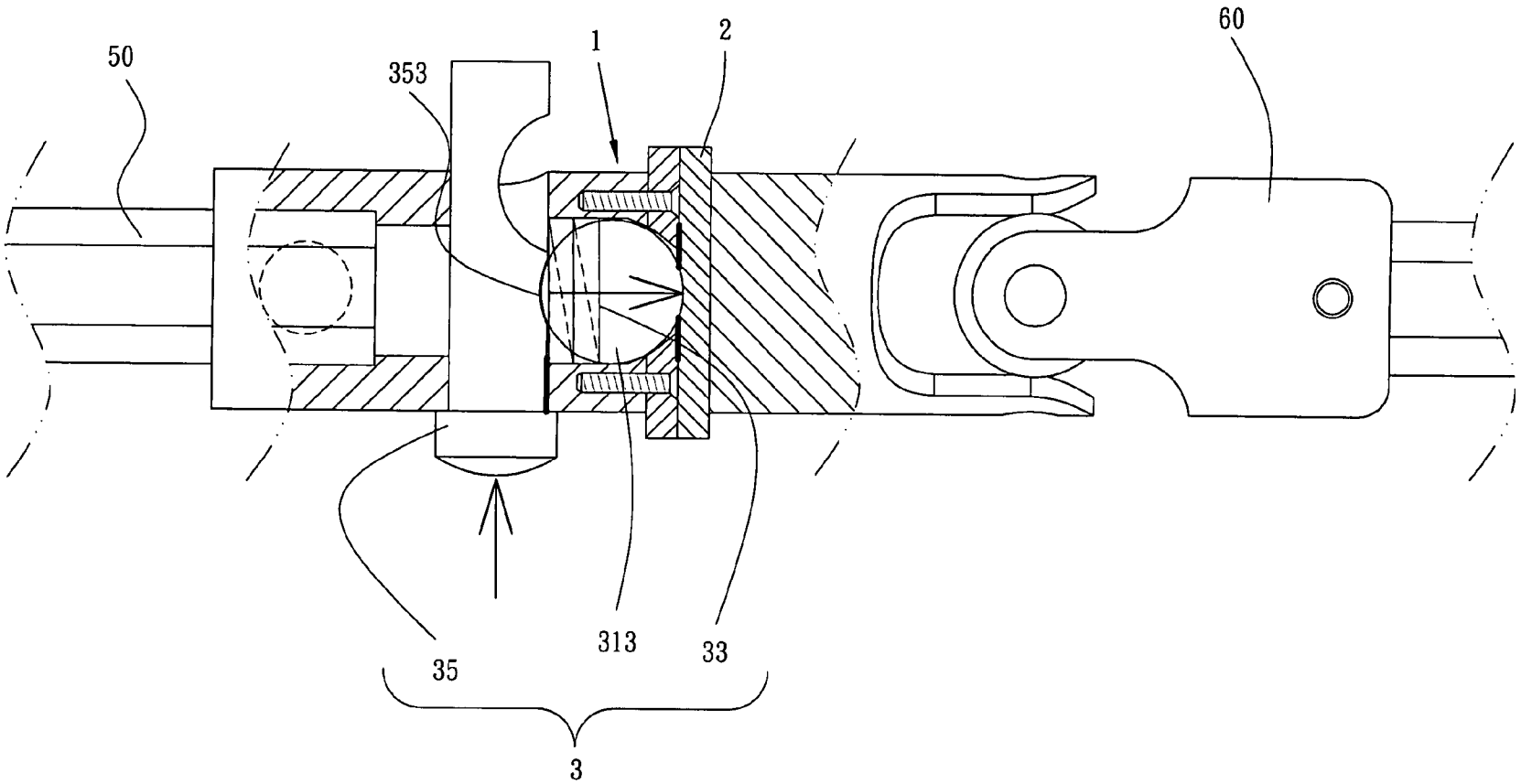
FIG. 7 is a schematic view showing the second status of the second embodiment of the invention.

For the second embodiment, please refer to FIGS. 6 and 7. When the connectors 1, 2 have engaged with each other and the pin 35 has not pressed the central positioning member 31 yet, the whole central ball 313 is in the first connector 1, and a portion of the central ball 313, which is towards the second connector 2, is pushed by the elastic member 33 to move back into the first connector 1. Additionally, the other end of the central ball 313 is formed with a protrusion 312 which can be temporarily positioned in the backward positioning recess 351 as shown in FIG. 6. When a user pushes the pin 35 inwards, the central ball 313 is forced by the pin 35 to move into central holes of the first and second connectors 1, 2 to ensure accurate engagement between the first connector 1 and the second connector 2. When disassembling, the pin 35 should be slightly pulled out to release the central ball 313. At this time, the central ball 313 moves backwards into the first connector 1. Finally, a user may disassemble the engaged connectors 1, 2 by separately removing the engaging portions 11, 21 from the second inserting portions 23, 13. Thus users can assemble or disassemble the pedal assembly with bare hands. Because the connectors 1, 2 are coupled by engagement and the central positioning member is placed in the central holes of the connectors 1, 2, the shaft 50 and the universal joint 60 can be rotated coaxially and synchronously. This can simplify the structure, reduce the time delay between stepping and hitting and improve playing quality.

What is claimed is:

1. A bass drum pedal assembly of a drum kit, comprising:

a first connector, mounted on a shaft driven by a drum pedal;

a second connector, engaging with the first connector, and coupled to a universal joint which links a connecting rod; and a positioning mechanism, comprising a central positioning member, an elastic member and a pin, wherein the elastic member is put around the central positioning member to make the central positioning member elastically slidably disposed in a central hole of the first connector, the pin is inserted into a through hole at a lateral side of the first connector to press the central positioning member and the elastic member so that the central positioning member is elastically inserted in central holes of the first connector and the second connector;

wherein each of the first connector and the second connector includes an end portion that is of an L shape, a side of the first connector end portion is formed with a first engaging portion, a side of the second connector end portion is formed with a second engaging portion, and the first and second connectors can engage with each other by inserting the first engaging portion into a second inserting portion of the second connector and inserting the second engaging portion into a first inserting portion of the first connector.

2. The bass drum pedal assembly of claim 1, wherein the pin is formed with a forward positioning recess for temporarily positioning the central positioning member when the elastic member is fully compressed.

3. The bass drum pedal assembly of claim 2, wherein the pin is formed with a backward positioning recess for temporarily positioning the central positioning member when the elastic member is not fully compressed.

4. The bass drum pedal assembly of claim 3, wherein the backward positioning recess is deeper than the forward positioning recess.

5. The bass drum pedal assembly of claim 1, wherein the elastic member is a spring.

6. The bass drum pedal assembly of claim 1, wherein the central positioning member is a central ball.

7. The bass drum pedal assembly of claim 1, wherein the central positioning member is a central bar.

8. The bass drum pedal assembly of claim 7, wherein an end of the central bar is formed with a protrusion.

9. The bass drum pedal assembly of claim 1, wherein the first connector further comprises a stopper bolt for ensuring the shaft to be firmly fastened to the first connector.

10. The bass drum pedal assembly of claim 1, wherein the pin is formed with a backward positioning recess for temporarily positioning the central positioning member when the elastic member is not fully compressed.

* * * * *